United States Patent [19]

Harasym et al.

[11] 4,450,986

[45] May 29, 1984

[54] APPARATUS FOR UNPLUGGING A VESSEL DISCHARGE PORT

[76] Inventors: Michael F. Harasym, 125 E. Hathaway La.; Benjamin A. Lanza, 2407 Merwood La., both of Havertown, Pa. 19083

[21] Appl. No.: 396,947

[22] Filed: Jul. 9, 1982

[51] Int. Cl.[3] ..... B22D 41/10

[52] U.S. Cl. ..... 222/591; 222/593; 222/603

[58] Field of Search ..... 222/603, 593, 591, 590, 222/1, 149, 148; 146/437, 335, 483; 266/271

[56] References Cited

U.S. PATENT DOCUMENTS 3,201,225 8/1965 Haynes ..... 266/271

3,743,139 7/1973 Lyman ..... 222/1

3,794,218 2/1974 Yanagida et al. ..... 222/1

*Primary Examiner*—Joseph J. Rolla

*Assistant Examiner*—Thomas C. Fitzgerald

*Attorney, Agent, or Firm*—Seidel, Gonda & Goldhammer

[57] ABSTRACT

The unplugging apparatus includes an annular member having a refractory ring on its inner surface. A housing is supported by the member and connected to a radially disposed conduit. A tube in the housing is guided for upward movement by the housing. A nozzle may be provided on the upper end of the tube. The tube has a reaction surface within the housing and is adapted to be projected upwardly by gas introduced into the housing from the conduit. The tube has a passage so that the gas from the housing may be discharged through the nozzle.

7 Claims, 5 Drawing Figures

FIG. 1
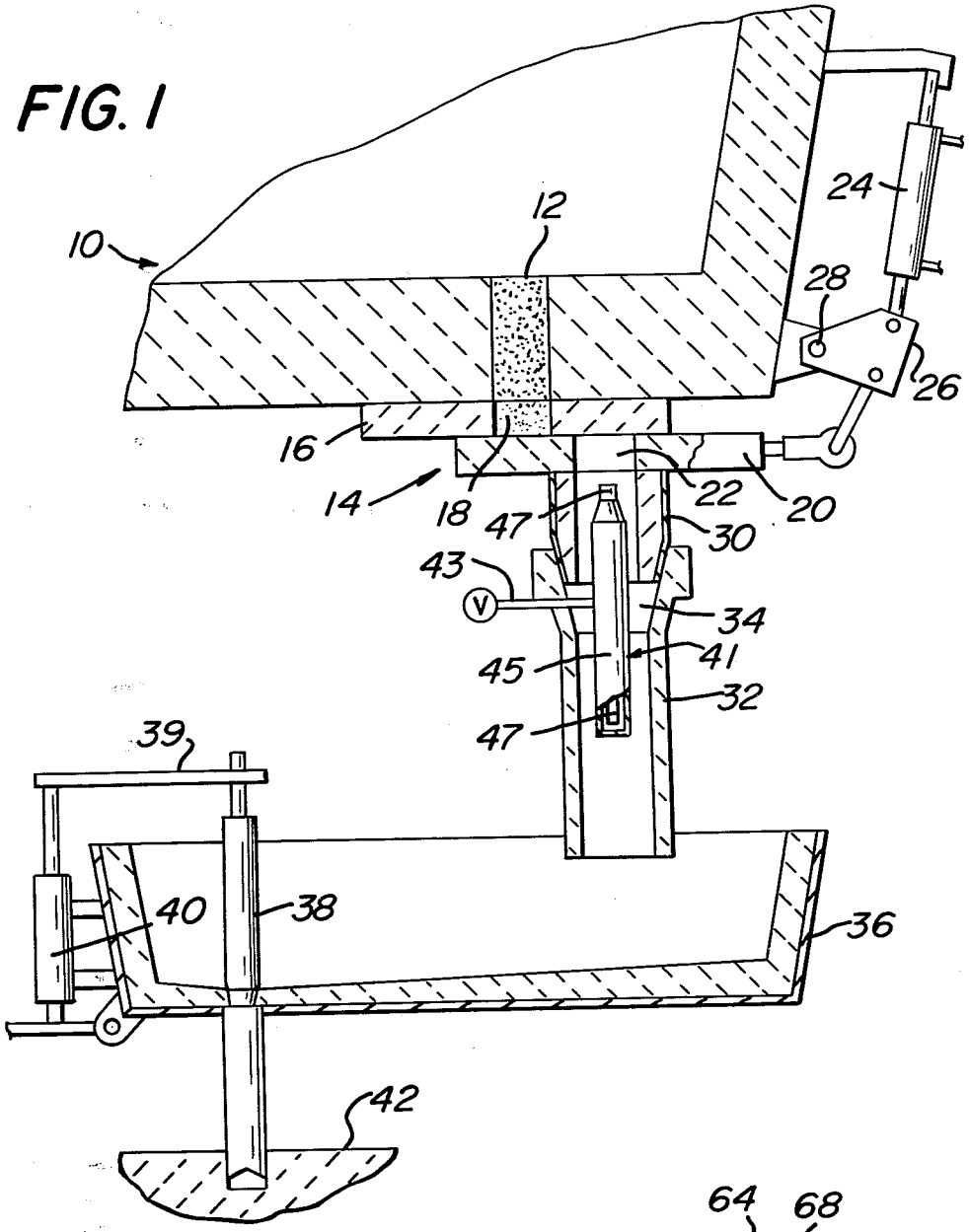
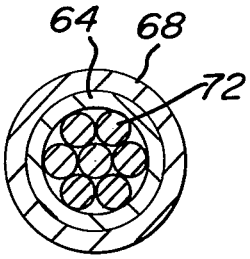
FIG. 5

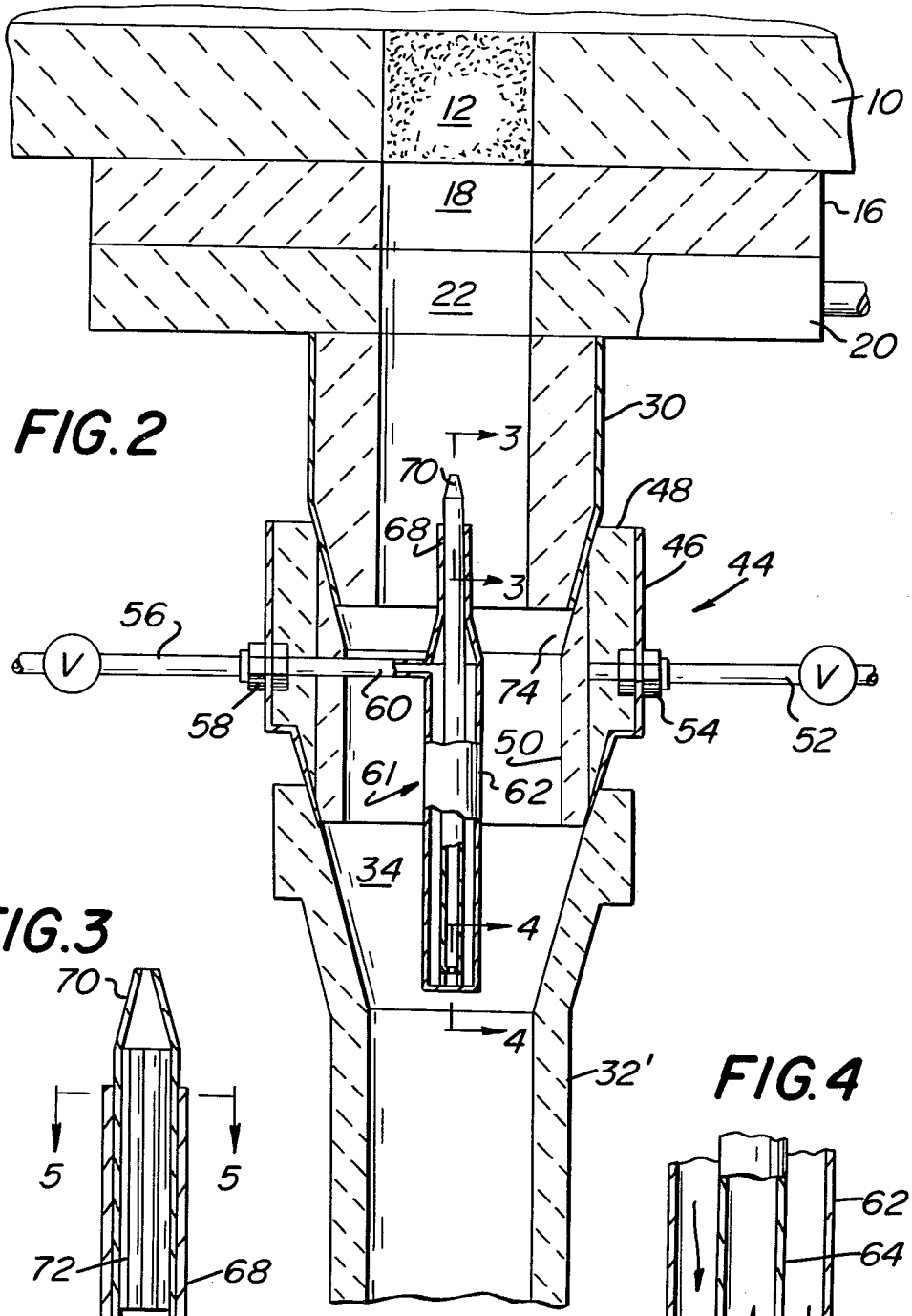
FIG. 2
FIG. 3
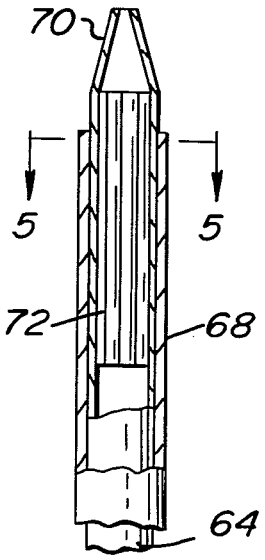
FIG. 4
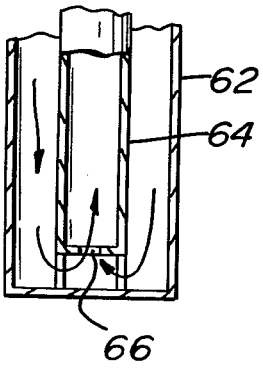

APPARATUS FOR UNPLUGGING A VESSEL DISCHARGE PORT

BACKGROUND OF THE INVENTION

In vessels for molten metal having a discharge port which is controlled by a gate valve for the like, the port is frequently plugged. A number of devices have been proposed for unplugging the port. For example, see U.S. Pat. Nos. 3,743,139 and 3,794,218. To my knowledge, none of said devices have been totally satisfactory. The present invention is directed to solution of the problem of providing a simple, reliable and inexpensive device which will facilitate unplugging a discharge port in the vessel while being safe and inhibiting contamination of the molten metal.

SUMMARY OF THE INVENTION

The apparatus of the present invention is designed for unplugging a discharge port. In one embodiment the apparatus is adapted to be removably positioned between a nozzle and a shroud. The apparatus is an annular member having a refactory inner surface. A housing is supported within the member and is generally coaxial therewith. A conduit extends from the exterior of said member to the interior of said housing. A tube is guided for upward movement by said housing. A nozzle may be provided on the upper end of said tube. The tube has a reaction surface within said housing and is adapted to be projected upwardly from a retracted position to an extended position by gas introduced into the housing from said conduit. The tube has passage means so the gas from said housing may discharge through said nozzle or opening.

It is an object of the present invention to provide a novel apparatus for unplugging a vessel discharge port.

It is another object of the present invention to provide apparatus which may be removably positioned between a ladle discharge nozzle and a shroud to facilitate unplugging a ladle discharge port with the shroud in place.

It is another object of the present invention to provide an expendable inexpensive device which is reliable for unplugging discharge ports.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a vertical sectional view of a system including a ladle, shroud and tundish.

FIG. 2 is a vertical sectional view of the ladle and shroud shown in FIG. 1 but incorporating another embodiment of the present invention.

FIG. 3 is a sectional view taken along the line 3—3 in FIG. 2 but on an enlarged scale.

FIG. 4 is a sectional view taken along the line 4—4 in FIG. 2 but on an enlarged scale.

FIG. 5 is a sectional view taken along the line 5—5 in FIG. 3 but on an enlarged scale.

DETAILED DESCRIPTION

Referring to the drawing in detail, where like numerals indicate like elements, there is shown in FIG. 1 a vessel 10 having a discharge port 12 in a bottom wall thereof. For purposes of illustration the vessel 10 will be a ladle. Flow of discharge of molten metal through port 12 is controled by a gate valve 14.

The gate valve 14 includes a stationary plate 16 attached to the bottom wall of the ladle 10. Plate 16 has a flow passage 18 aligned with the port 12. A moveable plate 20 is juxtaposed to plate 16 and has a flow passage 22 off set from flow passage 18 in the closed position of valve 14 as shown. Plate 20 is provided with an actuator which may assume a wide variety of configurations. For purposes of illustration, the actuator includes a hydraulic cylinder 24 having a piston rod pivotaly connected to one end of a link 26. The other end of link 26 is pivotaly connected to a second link pivotaly connected to one end of the plate 20. Link 26 pivots about pivot 28.

The moveable plate 20 has a nozzle 30 fixedly secured thereto and coaxial with the flow passage 22. Nozzle 30 is preferably a refractory ring having metal liner on its outer surface. The discharge end of nozzle 30 is tapered on its outer periphery and mates with tapered surface 34 on an annual member such as shroud 32. Shroud 32 is made from a refractory. The flow passage through the shroud 32 is coaxial with flow passage 22 and the flow passage through the nozzle 30 in the open position of plate 20.

The shroud 32 is supported for vertical movement toward and away from the nozzle 30. Such support is not illustrated and is conventional in the art. The lower end of the shroud 32 communicates with the upper end of a tundish 36. The discharge from the tundish 36 includes a port off set from the shroud 32 and controlled by a vertical stopper rod 38. Rod 38 is vertically moveable from the closed position shown to an open position by a hydraulic cylinder 40. Rod 38 is connected the piston rod associated with cylinder 40 by way of arm 39. The flow port from the tundish 36 communicates by way of a shroud with a cavity in mold 42.

When the valve 14 is opened, the flow port is frequently plugged by sand or a solidified skin of molten metal. A telescoping lance 41 is supported within shroud 32 by conduit 43. The lance 41 includes an outer housing 45 and an inner tube 47. A gas such as oxygen may be introduced into housing 45 by way of conduit 43 to cause tube 47 to move upwardly to physically contact the sand or skin. Heat from the molten metal will ignite oxygen discharging from the upper end of tube 47 to melt the skin of molten metal. The lance 41 is consumed by the molten metal.

In accordance with the preferred embodiment of the present invention, the shroud 32' is conventional and is lowered so that an unplugging device in accordance with the present invention is supported in the upper end thereof Thereafter, the device and shroud are raised until the device is coupled to the nozzle 30.

As shown more clearly in FIG. 2, the device 44 is an annular member which includes a metal liner 46 surrounding an outer refractory liner 48 which in turn surrounds an inner refractory liner 50. Refractory liner 48 is preferably a porous refractory material while liner 50 is preferably impervious refractory. A valved conduit 52 is connected to a quick connect fitting 54 on the device 44. Fitting 54 communicates with the interface between the liners 48, 50. An inert gas such as argon may be introduced to such interface by way of conduit 52. If liners 48 and 50 are made in one piece, conduit 52 may be eliminated.

A valved conduit 56 is coupled to a quick disconnect fitting 58 on device 44. Fitting 58 communicates with conduit 60 which extends radially inwardly and supports a telescoping lance 61 including a housing 62. Lances 41 and 61 are identical. Housing 62 is generally coaxial with the refractory liners 48, 50 and has an axial length greater than the axial length of said liners. Within the housing 62 and spaced from the inner surface thereof, there is provided a tube 64. Tube 64 has a reaction surface on its lower most end as shown more clearly in FIG. 4. The reaction surface contains a hole or passage 66. The tube 64 is guided for vertical movement by a cylinder portion 68 of the housing 62. The upper end of the tube 64 may terminate in a nozzle 70. Within the tube 64, there may be provided combustible material such as magnesium, low carbon steel, etc. Thus, magnesium wires 72 are provided as shown more clearly in FIG. 3.

Operation of the preferred embodiment is as follows. When the slide valve 14 is opened, and molten metal does not discharge through the nozzle 30, the slide valve is immediately closed. The shroud 32' is lowered. The device 44 is positioned on top of the shroud. Thereafter, the device 44 and shroud 32' are elevated until the tapered surface 74 on the upper end of the liner 50 mates with the taper on the outer surface of the lower end of the nozzle 30. Thereafter, inert gas is introduced to the interface between liners 58 and 50 by way of conduit 52.

The slide valve 14 is opened again, and thereafter, a gas capable of being ignited such as oxygen is introduced from conduit 56, through conduit 60, into the housing 62. The oxygen extends the tube 64 to position it into the aligned passages of the gate valve 14. The oxygen also enters the hole 66 and discharges through the nozzle 70. The heat of the adjacent molten metal ignites the oxygen and/or other combustible material to thereby provide a device similar to a blow torch for unplugging the sand or skin of molten metal preventing flow of molten metal from the discharge port 12. If desired, the oxygen could be ignited at nozzle 70 before device 44 and shroud 32' are elevated in position.

When the port 12 is unplugged, the molten metal flows through the passages 18 and 22, through the nozzle 30, through the device 44 and through shroud 32 to the tundish 36. Conduit 60 as well as housing 62 and tube 64 are consumed by the molten metal and therefore are preferably made from a material such as thin walled low carbon steel which does not chill the molten metal and does not introduce any impurities. The inert gas continues to be introduced into the interface between liners 48 and 50 so long as molten metal is flowing from the ladle 10. As soon as molten metal commences flowing from the ladle 10, an inert gas such as argon is substituted for the gas flowing through conduit 60. After all the molten metal has been transferred from the ladle 10 to the tundish 36, the device 44 is removed. The device 44 may be considered expendible and discarded or in the alternative a new housing 62 and conduit 60 may be attached for reuse of the device 44.

The present invention may be embodied in other specific forms without departing from the spirit or essential attributes thereof and, accordingly, reference should be made to the appended claims, rather than to the foregoing specification, as indicating the scope of the invention.

We claim:

1. Apparatus for unplugging a discharge port comprising an annular member having a refractory inner surface, a housing supported within said member and generally coaxial therewith, a conduit extending from the exterior of said member to the interior of said housing, a tube guided for upward movement by said housing, an opening at the upper end of said tube, said tube having a reaction surface within said housing and adapted to be projected upwardly by gas introduced into the housing from said conduit, said tube having passage means so that gas from said housing may enter the tube and discharge through said opening.

2. Apparatus in accordance with claim 1 wherein the upper end of said refractory surface is tapered on the inner surface thereof for mating with a tapered surface on a nozzle adapted to be positioned thereabove.

3. Apparatus in accordance with claim 1 wherein the lower end of said member has a taper on its outer surface for mating with a tapered shroud adapted to be disposed therebelow.

4. Apparatus in accordance with claim 1 wherein said housing and tube are expendible after a single use.

5. Apparatus in accordance with claim 1 wherein said housing is longer than the axial length of said member and projects downwardly below the elevation of the bottom surface of said member.

6. Apparatus in accordance with claim 1 wherein said member includes an outer refractory ring surrounding said first mentioned refractory ring, and a metal liner surrounding said outer refractory surface said outer refractory ring being porous.

7. Apparatus in accordance with claim 5 including a second conduit extending from the exterior of said member to the interface between said refractory layers for introducing therein an inert gas.

* * * * *